United States Patent [19]

Becker

[11] Patent Number: 5,012,921

[45] Date of Patent: May 7, 1991

[54] CARRYING BAG FOR SKIS, BOOTS THEREON AND POLES

[76] Inventor: Lane T. Becker, 3115 Fairway Ct., Coeur d'Alene, Id. 83814

[21] Appl. No.: 393,215

[22] Filed: Aug. 14, 1989

[51] Int. Cl.[5] ..... A45C 13/20; A63C 11/10; B65D 85/18

[52] U.S. Cl. ..... 206/315.1; 224/917; 280/814; 294/147

[58] Field of Search ..... 206/315.1; 224/917; 294/147; 280/814, 815; 150/154

[56] References Cited

U.S. PATENT DOCUMENTS

| | | | |
|---|---|---|---|
| 1,976,698 | 10/1934 | Gihon, III | 206/315.1 X |
| 3,272,526 | 9/1966 | Rumaner | 280/814 |
| 3,348,665 | 10/1967 | Andretich | 206/315.1 |
| 3,368,655 | 2/1968 | Purdy | 206/315.1 |
| 3,394,781 | 7/1968 | Woolworth | 206/315.1 |
| 3,399,750 | 9/1968 | Woolworth | 206/315.1 |
| 3,737,171 | 6/1973 | Becker | 206/315.1 X |
| 3,767,036 | 10/1973 | McLeod | 206/315.1 |
| 3,909,031 | 9/1975 | Schmaedeke et al. | 206/315.1 X |
| 3,917,137 | 11/1975 | Wilkins | 294/147 |
| 4,055,287 | 10/1977 | Champenois, Jr. | 294/147 X |
| 4,126,255 | 11/1978 | Olson | 294/147 |
| 4,131,289 | 12/1978 | Maller | 294/147 X |
| 4,152,002 | 5/1979 | Olson | 280/814 |
| 4,261,493 | 4/1981 | Newman | 294/147 X |
| 4,674,787 | 6/1987 | DeVera | 294/147 |
| 4,746,159 | 5/1988 | Webb et al. | 206/315.1 X |
| 4,792,073 | 12/1988 | Jacober | 294/147 X |

FOREIGN PATENT DOCUMENTS

| | | | |
|---|---|---|---|
| 795647 | 10/1968 | Canada | 294/147 |
| 1204459 | 5/1986 | Canada | 280/814 |
| 2013813 | 10/1971 | Fed. Rep. of Germany | 206/315.1 |
| 1299186 | 6/1962 | France | 280/814 |
| 2563112 | 10/1985 | France | 280/814 |
| 655447 | 4/1986 | Switzerland | 280/814 |

*Primary Examiner*—Sue A. Weaver

[57] ABSTRACT

A flexible bag to fit over and carry the medial portions of a pair of skis, in side by side relationship, with ski boots in place in the bindings of the skis. The bag provides similar sides that overlap to define a closable, vertically orientated medial opening for equipment placement communicating with end openings to allow ski and pole projection therethrough. A rigid skid plate on the forward bottom portion of the bag aids skidding transport over a supporting surface. An elongate carrying strap may be selectively positioned through plural fasteners on the bag surface to secure bag closure and the strap may be fastened to an external object to aid in preventing theft of either bag or equipment therein during transport or storage. Ski poles may be carried above skis and between boots in the bag. Separable tubular covers protect the end portions of skis and poles projecting beyond the ends of the bag.

7 Claims, 2 Drawing Sheets

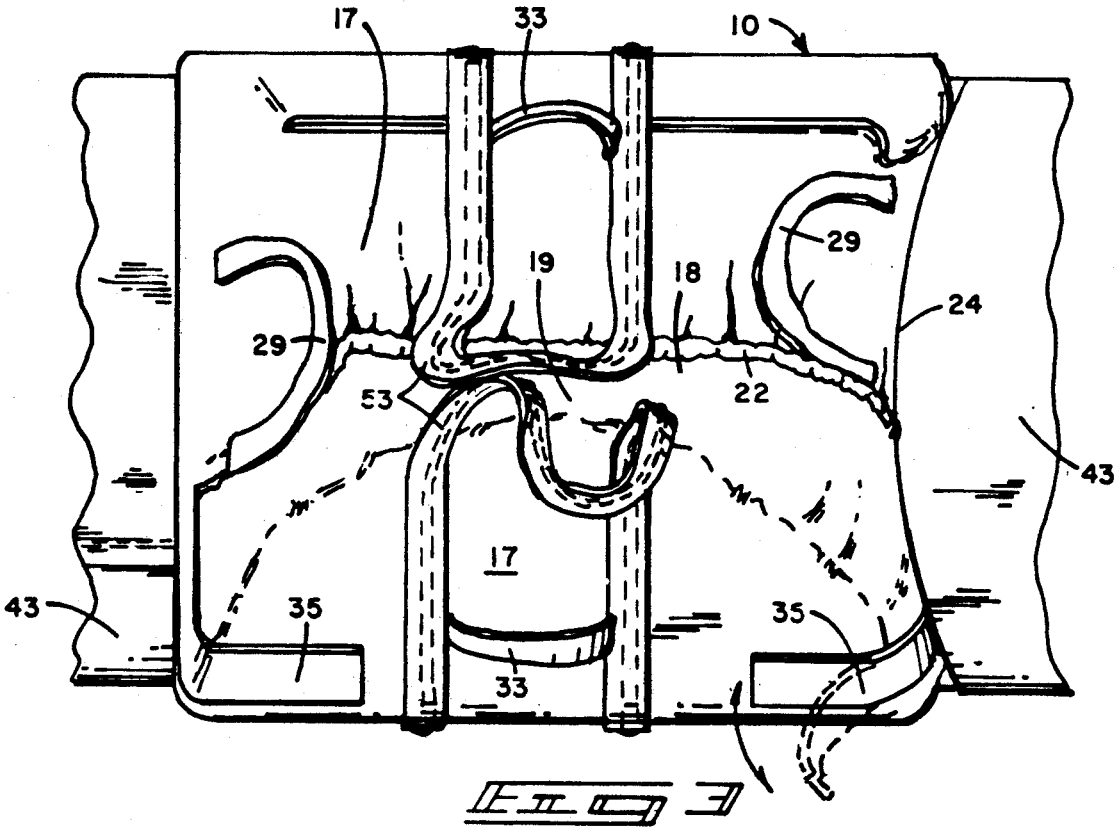
FIG 3
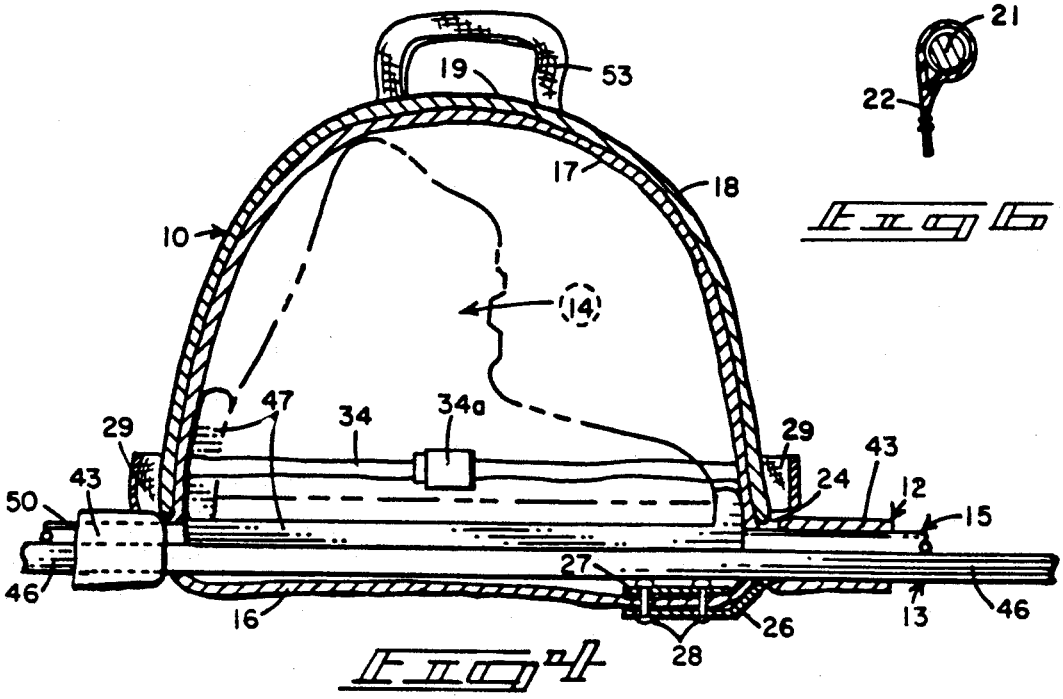
FIG 4
FIG 6

CARRYING BAG FOR SKIS, BOOTS THEREON AND POLES

BACKGROUND OF INVENTION

1. Related Applications

There are no pending applications relating hereto heretofore filed in this or any foreign country.

2. Field of the Invention

My invention relates generally to carrying-type containers for skI equipment and more particularly to a flexible bag that covers the medial portion of a pair of skis with boots thereon and ski poles therebetween.

3. Description of Prior Art

The sport of skiing has developed through most of the world, in areas where it may be practiced, to a high degree of both popularity and sophistication. With this development, equipment for skiing has correspondingly sustained a similar developmental pattern with resulting complexity and higher equipment cost. This historicity has created a need for more functional carriers and protectors for skis and associated equipment. The instant invention seeks to fulfill this need by providing a flexible bag that covers, aids carrying and provides security for skis, boots and poles.

The particular elongate configuration of skis makes their containment and transport difficult and this difficulty increases if a container is to provide carrying means and also is to contain other ski related equipment. Secondarily, if skis are to be contained for storage or transport, it is quite desirable that the equipment be readily removable from the containment means so that those containment means do not unnecessarily take time from skiing activities. It is also desirable that the containment means be storable, with or without skis and associated apparatus, in some secure fashion to prevent theft, as the increased sophistication of skiing gear, with its attendant increased cost, has increased proportionately the potentiality of theft. The instant invention seeks to solve these problems.

Modern skiing equipment in general includes not only skis, but also boot harnesses on the skis, semi-rigid boots of quite specialized nature and configuration adapted to releasably fit in the boot harnesses, and ski poles. Various carriers for some or all of these items, both singly and in combinations, have heretofore become known. In general, ski boots have been carried in carriers that are separate and distinct from carriers for skis themselves, and ski poles have sometimes been carried in individual carriers, but more commonly in carriers designed principally for carriage of skis. These known carriers, that do not associate all three articles in a single containment and carriage device, are readily distinguishable from the instant invention which does provide simultaneous containment and carriage for all three items.

There also heretofore have been developed carriers for containment of an associated array of skis, boots and poles. These carriers, however, have generally been of a rigid nature and adapted particularly for air transport of skis and skiing apparatus by professional skiers. Such known devices generally have not positioned a pair of skis in side by side relationship for carriage and have not provided means for carrying ski boots in operative attached position on boot harnesses of the skis, as does the instant invention which allows compact containment and maintenance of these items in relationship for potential use without further assemblage.

My carrier bag further provides a releasably attached elongate strap which allows it to be supported over a skier's shoulder or pulled on the ground behind a skier, especially by releasing one end of the strap from the bag. Prior devices in general have not provided for either shoulder-type carriage or skid-type transport over a supporting surface. In general, aside from lack of a strap, prior containment and carriage devices often would not, by reason of their construction, have allowed such skidding-type transport at all.

My bag also provides a security device both for skiing apparatus carried in it and for the bag itself when it is being stored. The bag provides peripheral fastening elements through which the elongate strap may be laced to secure the containment bag from access. The strap may then be passed through or around some suitable object, such as a tree, post or part of a structure, and locked thereto so that neither the bag nor its contents may be surreptitiously removed from their preestablished position. The bag may be similarly fastened to some object after removal of ski gear and during periods of empty storage. Prior art devices in general have not provided means of securing either the bag itself or the bag and items carried therein from theft or pilferage, though the possibilities of these activities are ever present and have increased substantially in the present day, not only because of the increased cost and value of ski equipment, but also because of general deterioration of moral values and respect for the law in modern culture. It should be noted that the object to which the bag is secured may well be an automotive vehicle to allow use of my container bag as a security means during vehicular transport of ski equipment to and from skiing areas.

My invention does not reside in any one of these structures or features per se, but rather in the synergistic combination of all of them and the functions necessarily flowing therefrom as hereinafter further specified and claimed.

SUMMARY OF INVENTION

My invention generally provides a flexible containment bag, with carrying means, that fits over the medial portions of a pair of skis in side by side relationship with a pair of ski boots in place in the bindings on such skis and optionally with ski poles between the boots.

The bag defines overlapping releasably fastenable sides extending upwardly from a bottom to define a medial vertical opening for placement of skis and equipment upon the bottom and extending through each opposed bag end. A rigid planar skid plate is carried on the outer surface of the forward portion of the bag bottom to aid bag transport by pulling and skidding over a supportive surface. The bag provides an elongate, releasably fastenable strap which may be used as a tether in pulling the bag or as a strap for support on a user's shoulder. The bag defines about its outer surface a plurality of strap fasteners through which the elongate strap may be carried to closably secure the bag. The strap may be locked to itself or about an object external to the bag to prevent theft of the bag and contents.

Ski poles may be supported in the bag between carried skis and boots. Auxiliary tubular covers protect the forward and rearward end portions of skis and poles that project beyond the carrying bag. The bag and tubular covers are formed of flexible material, provide releasable closure fastening means for openings, and the bag handles to aid hand carrying.

In creating such a device, it is:

A principal object of my invention to provide a flexible carrying bag for a pair of skis in side by side array, with ski boots operatively positioned in binders provided therefore on such skis.

A further object of my invention to provide such a carrying bag that defines a medial elongate releasably closable opening for placement of skis and boots to be carried and a rigid bottom skid plate to allow skidding of the device upon a supportative surface without excessive damage or wear to bag or contents.

A further object of my invention to provide such a bag that has an elongate strap, carrying a metal cable within its structure, that is releasably attachable to the bag to serve as a shoulder support and as a tether for pulling the bag over a supporting surface.

A still further object of my invention to provide such a carrier bag that provides plural fasteners about its outer surface, to allow the elongate strap to be threaded therethrough and fastened to itself or about some stationary object to secure the bag and objects which it may contain from pilferage.

A still further object of my invention to provide such a bag that may carry ski poles in adjacent, parallel array adjacent skis and between boots.

A still further object of my invention to provide such a bag that covers the medial portions of a pair of skis with boots thereon and provides separate releasably positionable auxiliary covers for the forward and rearward parts of skis and poles projecting from the bag.

A still further object of my invention to provide such a device that is of new and novel design, of rugged and durable nature, of simple and economic manufacture and otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement, with only one preferred and practical embodiment of the best known mode of operation being illustrated and specified as is required.

BRIEF DESCRIPTION OF DRAWINGS

In the accompanying drawings which form a part hereof and wherein like numbers of reference refer to similar parts throughout:

FIG. 3 is an orthographic top view of the bag of FIG. 2, with the bag strap partially removed for clarity of detail.

FIG. 4 is a vertical cross-sectional view through the bag of FIG. 1, showing the manner of containment of skis and boots within the bag as well as constructional details of the bag.

FIG. 6 is an enlarged cross-sectional view of the elastically biased seam structure of the overlapping edge of a side of the bag, taken on the lines 6—6 of FIG. 5 in the direction indicated by the arrows.

DESCRIPTION OF THE PREFERRED EMBODIMENT

Figure 1:
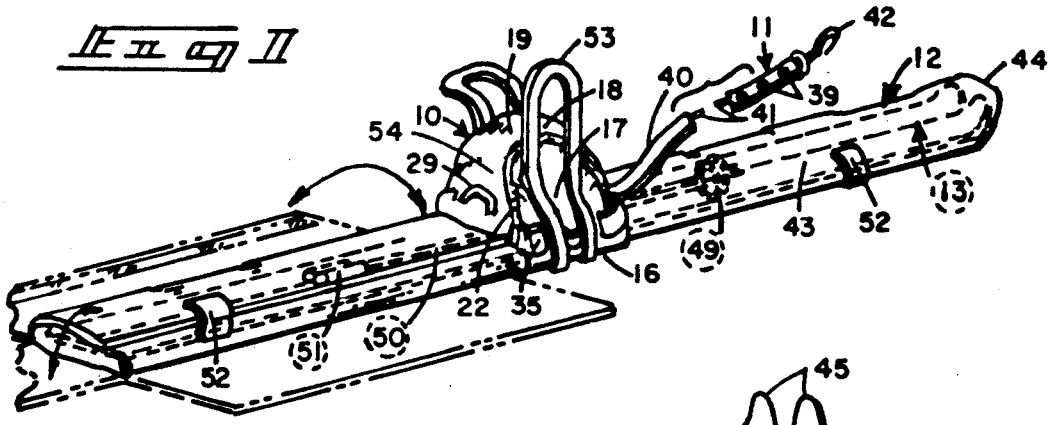
FIG. 1 is an isometric view showing my bag in place to cover the medial portion of a pair of skis, with boots carried thereon, and auxiliary covers for the projecting end portions of the skis and carried ski poles.
Figure 5:
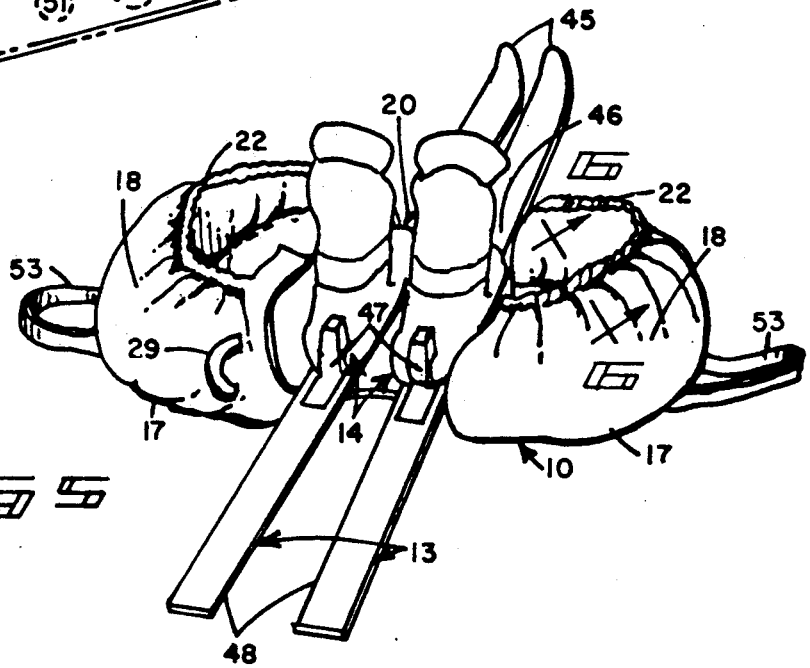
FIG. 5 is an isometric view of a pair of skis with supported boots positioned in an opened bag.
Figure 2:
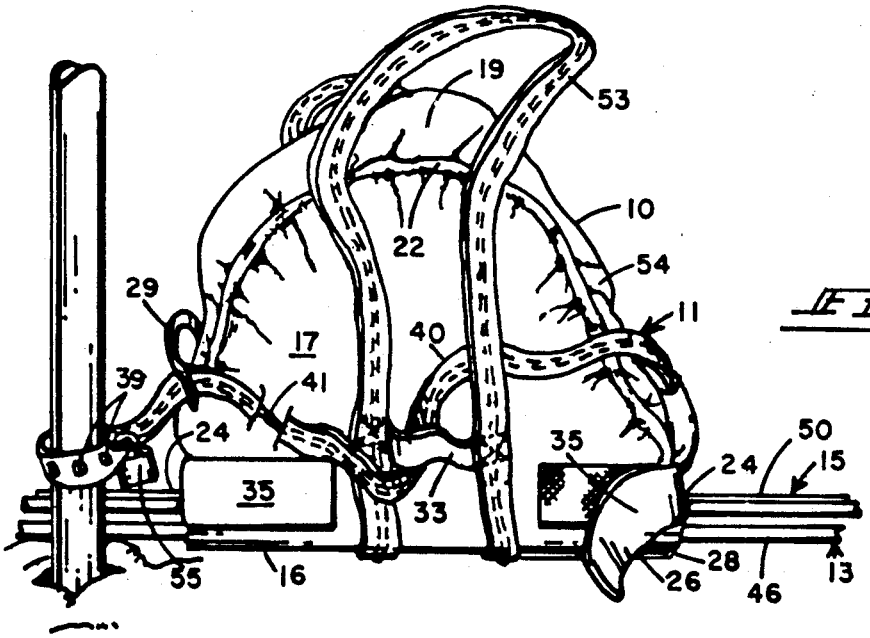
FIG. 2 is an orthographic side view of my invention in a closed containment mode and fastened to a post, showing its various parts, their configuration and relationship from this aspect.

My invention generally provides bag 10, with associated strap 11, to cover the medial portion of skis 13 with boots 14 in place in harnesses thereon and poles 15 optionally supported therebetween. Auxiliary covers 12 cover the projecting end portions of skis and poles.

Bag 10 comprises a peripherally defined, somewhat bulbously configured container, of the general shape of a laterally adjacent pair of ski boots, formed by structurally interconnecting bottom 16 and similar sides 17 having overlapping portions 18 which aid in maintaining closure. Sides 17 are of somewhat semi-circular shape to cooperate with rectilinear bottom 16 and bag top portion 19 to form the geometrical configuration indicated and illustrated. The various bag elements are joined in edge to edge relationship, where necessary, by known mechanical joining means such as sewn overlapping seams.

The sides cooperate to define elongate vertically orientated medial opening 20, in the instance illustrated releasably closable by the adjacent overlapping portions 18 of the bag sides. Additionally, the peripheral edge of each overlapping side portion 18 is folded back upon itself and fastened with seam 22 to define an elongate channel carrying an elongate elastic element 21 to cause the seam structure, and inwardly adjacent bag portion, to gather together by reason of the bias created by the elastic element therein. Since this peripheral portion of each side extends over the tops of boots to be carried in the bag, and somewhat downwardly on the other side of the boots, the general geometry of the bag tends to maintain side closure which is enhanced by the elastic bias, to maintain closure yet readily allow opening by appropriate manual manipulation. Additional strap fasteners 35 also aid in holding the lower portions of the sides together. These strap fasteners 35 preferably are provided at least in the lower end portion of the overlapping bag side at each bag end, immediately above a pair of skis carried in the bag. These strap fasteners 35 may be fastened at both ends by Velcro carried by adjacent surfaces of both bag and strap or one strap end may be permanently fastened to the bag as by sewing, riveting or the like.

Preferably the bag structure is formed of a flexible fabric-type material, with a nylon canvas being the material of choice. With such fabric material, the edges that need be joined are preferably joined by sewn overlapped seams. It may be desirable to provide the bag with interior insulation (not shown) and if this is done, the insulation material is joined by adhesion or seaming to the bag structure itself or incorporated within layers of bag material to maintain the integrity of the hag structure and its ease of use.

The lower adjacent portions of each overlapping part 18 of bag sides 17 define similar horizontally extending ski slots 24 to allow the passage of a pair of skis therethrough, when the skis be oriented in a side by side relationship and supported medially on bag bottom 16. Vertical medial opening 20 defined between sides 17 communicates with the ski slots 24 to allow positioning of a pair of skis in the slots by insertion through the opening. The area between the lower surfaces of skis 13 and bag bottom 16 may, if desired, be filled with some pliable, resiliently deformable material (not shown) to space carried skis from the bottom element and aid in positionally maintaining and protecting them.

The upper medial portions of sides 17 each structurally carry similar handles 53 which may be moved together over the top portion 19 of the bag to cooperate to provide means for hand carriage of the bag and also to aid in maintaining bag closure. These handles are formed of strap-like material, preferably with a flexible metallic cable as an integral part to provide strength and prevent severance. The strap handles are preferably formed as an endless band, as illustrated, with the medial portion extending about the bag and beneath its bottom portion and the handles constituting projecting looped end portions. These handles are not remarkable and may be of other types heretofore known for similar purposes in bags and luggage generally.

Bottom 16 of bag 10, on the forepart of its external surface, carries rigid skid plate 26, which extends laterally across this bag portion. The skid plate 26 serves as a surface to initially contact a supporting surface over which the bag may be pulled by skidding and because of this purpose the plate should be of a reasonably rigid and durable nature. The ideal material for the skid plate is a lighter metal such as aluminum or one of the more rigid, durable polymeric or resinous plastic materials. Preferably peripheral edges 28 are rounded and the plate is somewhat angulated, as illustrated, to aid skidding motion. The skid plate is positionally maintained on the undersurface of the bottom 16 of the bag by mechanical fastening. In the instance illustrated, a secondary fastening plate 25 of configuration somewhat similar to the skid plate is maintained on the inside of the bag with plural rivets 27 mechanically fastening the plates together with the bag therebetween. The only requirement of this joinder, however, is a mechanical interconnection of the bag bottom and skid plate, and this might be accomplished by adhesive materials or other known methods.

The lower medial portions of bag ends 54 structurally carry end fasteners 29 to aid interconnection of strap 11 with this portion of the bag. The fasteners 29 in the instance illustrated are straps formed as loops by having their end portions mechanically fastened to the bag structure, in the instance illustrated by sewing and rivet-type fasteners. This particular type of fastening structure is neither essential nor in nature remarkable in novelty and obviously other similar structures such as rings carried in loops of strap material (not shown) or similar structures may serve the same purpose in my invention. In fact these fasteners are optional and not necessary to my invention as the carrying strap may be otherwise fastened.

The exact dimensioning and configuration of bag 10 is not critical, but these attributes should be appropriate to allow the bag to at least cover the medial portion of a pair of skis, including the area of boot harnesses, with a pair of boots positionally maintained in those harnesses. Preferably the carrier bag is not much larger than required to accomplish this purpose, though obviously it could be of sufficient size to cover an entire pair of skis from end to end, if desired. I have found, however, that a smaller type container, such as that illustrated, is more convenient and efficient of use and less expensive of manufacture. With the bulbous bag configuration illustrated, there commonly will be little unoccupied volume when the bag carries its normal contents. Obviously the configuration and dimensioning of the bag could be expanded to allow carriage of auxiliary items in pockets or otherwise without departing from the essence, spirit or scope of my invention, should this be desired.

Side strap fasteners 33, of appropriate size and shape to carry strap 11 therein, are defined on the outer surface of each bag sides. These fasteners, in the illustrations, take the form of short straps on the lower portion of the bag sides, extending between the spaced portions of the handle strap and fastened at each end to the handle strap to form a loop therebetween. These fasteners might also take other forms, such as rings fastened by straps or the like, and yet remain within the shape of my invention. The purpose of these fasteners is to allow the bag strap to be laced therethrough to provide a secured closure for the carrying bag when it is not being carried and also allow its attachment to some fixed object to aid in preventing theft of it, its contents, or both. This purpose might be fulfilled by various other arrays of fasteners in other portions of the bag than those illustrated, and such other different arrays and positionings are within the contemplation of my invention. These variants are not illustrated in detail as they are obvious equivalents of the fasteners illustrated.

Additional boot fastening strap 34 optionally may be provided to extend between opposed lower end portions of inner side overlapping portion 18 to fasten the side member about boots to be covered. This strap is not necessary but aids ease of use, which is additionally enhanced if the belt's length be adjustable as by means of adjustably positionable buckle fastening means 34*a* in the medial portion of the strap.

Ski poles 15 optionally may be carried partially within bag 10 when positioned between boots 14 and skis 13, in an orientation parallel to the skis and with end portions extending from the carrying bag through the opposed ski slots 24. This mode of carriage requires no particular specialized structures and allows the poles to project through ski slots 24 together with skis in those slots.

Strap 11 is an elongate length of flexible band-like material 40 carrying at least one metallic cable 41 within its structure, preferably in a covered fashion. Preferably any strap type fasteners carried on the bag are of similar construction to aid in preventing severance and to provide strength. Strap 11 provides connectors 42 at each of its ends to interconnect with fastening loops 29 carried by bag 10 and additional medial fastening devices 39, in the illustrated form comprising grommets, for convenient security fastening of the bag. At least one end connector is releasably interconnectable with its associated fastener 29 by means of some releasable connecting device, such as the snap illustrated.

The length of strap 40 is such as to provide a carrying strap that may be placed over the shoulder of a user with an interconnected bag supported at a convenient position for carriage, which commonly requires a strap length of about six to seven feet. The cross-sectional dimension of strap 40 must be regulated in relationship to the size of fasteners on the bag so that the strap may be passed through those fasteners. To well serve its purpose, strap 40 is formed of a flexible material such as woven fabric belting and cable 41 should be formed of a reasonably strong, durable material that still has some flexibility, such as a stranded steel cable, to aid in preventing the breaking or cutting of the cable to allow pilferage of my bag or its contents when secured by the strap.

Auxiliary covers 12 each comprise elongate tubular bodies 43 with one closable outer end 44. These covers are formed of flexible fabric material and are of appropriate configuration and dimension to cover the end parts of a pair of skis and ski poles projecting beyond bag 10 when positioned to be carried in the bag. Preferably these auxiliary covers are provided with at least one band of elastic material to create some frictional engagement about at least a portion of apparatus to be covered to aid positional maintenance and the auxiliary covers may be releasably fastened to the bag 10 at areas of adjacency (not shown) if desired. In the instance shown, the auxiliary covers are formed as a flat sheet and fastened in tubular configuration by plural Velcro strap fasteners 52. The preferred material for the auxiliary covers is a woven fabric similar to that from which bag 10 is formed, such as nylon canvas.

Though auxiliary covers 12 might be releasably attached to bag 10, it has been found more convenient to make these members as separate unattached structures, as they may not be used at all times of bag use. The auxiliary covers are of such nature that they may be desirable for use with my bag, though they are not essential or necessary to my invention.

Having thusly described my invention, its use may be understood.

A typical pair of skis 13, defining tips 45, medial body portions 46 carrying boot binders 47, and rearward portions 48, are illustrated in the drawings. Similarly illustrated are ski poles 15, each having traditional tip structure 49 at a first end of elongate tubular body 50 and handles 51 at the second end of that body. Ski boots 14 may be of the many and various types, configurations and dimensions of present day commerce, but none of their various accidental parameters are of any particular consequence to my invention and in general, my invention is operative with most of the various ski boots that are commonly produced and used in present day ski activities.

To use my invention, a bag is formed according to the foregoing specification. If opening 20 be in a closed mode, the fasteners maintaining closure of that opening are manually manipulated to an open condition and the bag is positioned on some supportative surface, such as a table, floor or the earth. If ski boots 14 are not positioned in boot binders 47 of skis 46 to be carried in my bag, the boots are so positioned and the binders appropriately manipulated to releasably attach the boots to the skis. The skis with boots in place in their binders are then moved by a user, normally one at a time, downwardly through opening 20 defined in the bag, by appropriate manual manipulation of both ski-boot combinations and the bag, until the ski-boot combinations come to rest with the skis carried in ski slots 24 and the boots positioned so as to be containable within bag 10 when that bag be closed. With the bag structure in this condition the sides are manipulated to their closed overlapping condition and the opposed portions of fasteners 35 are manually manipulated to bring them into alignment and fastened to maintain closure of opening 20 for containment of the apparatus within the bag.

Normally, strap 11 will have been positioned with each of its ends interconnected to end fasteners 29 carried by the bag and if this be so, the bag is ready for shoulder carriage by means of the strap. If it be desired to pull the bag and contents over some supporting surface, especially such as a snow surface, the strap may be used with both ends connected to the bag or one end may be released from its interconnecting fastener and the strap then used as a longer tether.

If it be desired to carry ski poles in association with my bag, those poles are positioned with the medial portions of their bodies 50 within the bag, on skis therein and between the boots carried on such skis. When so positioned, the poles will be immediately adjacent to and parallel with the pair of skis carried in bag, as shown in dotted outline in FIG. 1 of the drawings.

If it be desired to cover the end portions of skis, poles, or both projecting beyond the bag, this may be accomplished by manually moving auxiliary covers 12 over each of those projecting portions. The auxiliary covers, once positioned, will be maintained by tensive resistance to their lengthwise motion relative to the skis and poles because of the elastic elements in their structure.

If it be desired to secure my bag and its contents against thievery or similar activity, strap 11 is released at one end and that released end is passed in order through a plurality of fasteners 29 and 33 and through the handle loops in a lace-like manner. The end of strap 11 is then passed through or about some stationary object, and preferably through an orifice therein that is completely peripherally enclosed, and the releasable end of the strap is then fastened again to some other portion of the strap, to the bag, or both, by means of a locking device, such as padlock 55. Fasteners 29, 33 are spaced on the bag so that when strap 11 is passed alternately through those fasteners, and the strap maintained in a reasonably taut condition, the bag cannot be effectively opened. When my invention be so configured, it is not generally possible to open the bag sufficiently to allow skis or boots to be removed through opening 20 and the entire bag structure will be securely attached to an object to or about which it is fastened. It should be noted that the bag may be attached to an automotive ski carrier or other portion of an automobile structure in its secured mode to prevent theft or pilferage of the bag and its contents during automotive transportation If strap 11 be removable from my bag at both of its ends, the strap may be established through fasteners in the bag in the same fashion as described and both ends of the strap then padlocked together or each strap end locked to the strap or bag by separate locks, after attachment to or about some stationary object. If ski poles are to be fastened against pilferage, they may have to be positioned so that strap 11 may be passed through an enclosed orifice defined by those poles, depending upon the ski pole configuration.

The foregoing description of my invention is necessarily of a detailed nature so that a specific embodiment of it may be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A carrying bag for skis, boots and poles comprising in combination:

a peripherally defined flexible bag configured to enclose the medial portions of a pair of skis having binders, with boots in place in the binders on the skis, said bag having a bottom attaching two similar upwardly extendable sides to define forward and rearward ends and a vertically oriented opening closable by overlapping adjacent portions of the sides, said opening communicating with cooperating ski slots defined in the opposed ends of the bag for carriage of skis within the bag in side by side relationship with end portions of the skis extending through the opposed ski slots;

means carried by the bag sides for releasably closed said vertically oriented opening; and means carried by the bag to aid its manual carriage.

2. The invention of claim 1 further characterized by:

the bag defining a plurality of fasteners forming closed perpheries and carried in spaced array on the outer surface of the bag on both sides of the vertically oriented opening defined thereon to fastenably receive a flexible strap and, an elongate flexible strap having fastening means at each end and extending through said fasteners to secure bag closure.

3. The invention of claim 2 further characterized by:

the flexible strap embodying an elongate flexible element, of strong durable nature and resistive t severance, substantially throughout its length to aid in preventing mechanical severance of the strap, and the flexible strap fastened to some object external of the bag by a locking device to aid in preventing theft of the bag and its contents.

4. The invention of claim 1 wherein the bottom of the bag carries a rigid skid plate on its forward lower surface to aid skidding of the bag over a supporting surface.

5. A bag for carrying a pair of skis having medial bindings and ski boots in place on the bindings on the skis, comprising in combination:

a flexible bag having a bottom and two opposed upwardly extending sides with overlapping portions to peripherally define a space to carry the medial portion of a pair of skis in side by side relationship with a pair of ski boots in releasably fastened position on bindings on said skis, said bag having opposed forward and rearward ends, a medial vertically extending opening communicating with ski slots defined in opposed ends of the bag sides upwardly adjacent the bag bottom to carry a pair of skis in side by side relationship and allow their passage through the ski slots, means for releasably closing said vertical opening, handle means carried by each bag side and extending upwardly therefrom to aid manual carriage of the bag, a rigid skid plate carried on the lower forward surface of the bottom of the bag to aid skidding over a supporting surface, and a plurality of strap fasteners forming closed loops carried in spaced array on the external surface of the bag to allow passage of a flexible strap therethrough for fastening the bag in closed condition; and an elongate flexible strap having fastening means at each of its ends extending through at least two of the aforesaid strap fasteners, said flexible strap having therein flexible cable means to aid in preventing mechanical severance of the flexible strap.

6. The invention of claim 5 further including paired, elongate, auxiliary covers to removably cover the end parts of skis projecting from the bag, said auxiliary covers having means to aid positional maintenance on the skis covered thereby.

7. The invention of claim 5 wherein the flexible strap is laced through at least a part of the plurality of fasteners defined on the bag and about an external object, and the said strap is fastened by locking means to aid in preventing theft of the bag and contents.

* * * * *